United States Patent [19]

Gundlach

[11] Patent Number: 4,920,244

[45] Date of Patent: Apr. 24, 1990

[54] VACUUM CLEANER SWITCH RETAINER

[76] Inventor: Joseph J. Gundlach, 121 Moonglow Dr., Belleville, Ill. 62221

[21] Appl. No.: 233,994

[22] Filed: Aug. 10, 1988

Related U.S. Application Data

[63] Continuation of Ser. No. 38,223, Apr. 14, 1987, abandoned.

[51] Int. Cl.[5] ..... H01H 3/20

[52] U.S. Cl. ..... 200/321; 200/43.16; 200/323

[58] Field of Search ..... 200/43.11, 43.13, 43.16, 200/43.17, 43.18, 43.19, 43, 21, 323–327, 157, 321, 322

[56] References Cited

U.S. PATENT DOCUMENTS

| | | | |
|---|---|---|---|
| 2,856,477 | 10/1958 | Schultz | 200/61.79 |
| 2,873,333 | 2/1959 | Jacaman | 200/296 |
| 3,117,208 | 1/1964 | Svensson | 200/322 |
| 3,158,726 | 11/1964 | Morgan | 200/43.18 |
| 3,217,559 | 11/1965 | Elligson | 74/527 |
| 3,678,236 | 7/1972 | Hughes | 200/43.18 |
| 3,766,352 | 10/1973 | Bigley et al. | 200/325 |
| 3,784,766 | 1/1974 | Johnson et al. | 200/43.16 |
| 3,929,035 | 12/1975 | Cohn | 74/616 |
| 4,006,334 | 2/1977 | Fobotham et al. | 200/157 |
| 4,034,167 | 7/1977 | Boyd | 179/178 |
| 4,379,953 | 4/1983 | Huff | 179/178 |
| 4,408,111 | 10/1983 | Domhan et al. | 200/323 |
| 4,468,544 | 8/1984 | Wainess et al. | 200/43.16 |
| 4,581,502 | 4/1986 | Grudzinskas | 200/43.16 |

*Primary Examiner*—Renee S. Luebke

*Attorney, Agent, or Firm*—Cohn, Powell & Hind

[57] ABSTRACT

An improvement for an electrically powered appliance (1) having an "ON-OFF" switch (7) which must be manually maintained in the "ON" position. A locking mechanism (11) includes a lever (25) slidably coacting with a switch button (9). The lever moves from a first position to a second position as the button is manually moved from the "OFF" to the "ON" switch position. When the lever reaches its second position it blocks the button from returning to the "OFF" switch position when manual force is removed.

6 Claims, 1 Drawing Sheet

OFF

VACUUM CLEANER SWITCH RETAINER

This application is a continuation of application Ser. No. 038,223, filed Apr. 14, 1987, now abandoned.

BACKGROUND OF THE INVENTION

This invention relates to electrically powered appliances utilizing mementary or pressure switches for application of power and, more particularly, to a locking mechanism for maintaining such switches in their power-on position.

Many electrically powered appliances such as vacuum cleaners, hand tools, and the like utilize a pressure activated switch to apply electrical power to the unit. Such switches are typically spring-loaded or otherwise biased to a power "OFF" position and require a constant finger or thumb pressure to maintain the switch in its power "ON" position. One problem with such a switch arrangement is that when prolonged rather than intermittent usage of the appliance is desired, maintaining this constant pressure becomes quite tiring. The resultant user fatigue is distracting to the user and depending on the type of appliance being used, potentially dangerous. Further, usage of the appliance necessarily immobilizes one of the user's hands possibly making it difficult to move the appliance on a work piece it is being used in conjunction with.

SUMMARY OF THE INVENTION

Among the several objects of the present invention may be noted the provision of a locking mechanism for use on electrically powered appliances having a spring loaded "ON-OFF" switch; the provision of such an invention for maintaining the switch in its unbiased or "ON" position without the constant application of manual force, i.e., thumb pressure; the provision of such invention which can be retrofitted on the appliance; and, the provision of such appliance which is easy and safe to use, eliminates user fatigue, and gives the user more freedom of movement in the worklace.

Basically, the present invention is directed toward an improvement to electrically powered appliances which have a multiple position or "ON-OFF" switch for controlling application of power to the appliances. In appliances where the switch is spring loaded or otherwise biased to the "OFF" position so the switch can be maintained in its "ON" position only by the constant application of manual force, the improvement comprises a locking mechanism for locking the switch in its "ON" position and maintaining it there. A portion of the locking mechanism slidably coacts with the switch and moves from a first to a second position as the switch is moved from its biased to its non-biased position. The locking mechanism locks the switch in its non-biased position when the mechanism reaches its second position and maintains the switch in that position until released.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 2, 3, 4, 5, 6, 7, 8, 9, 10, 11, 12, 13:
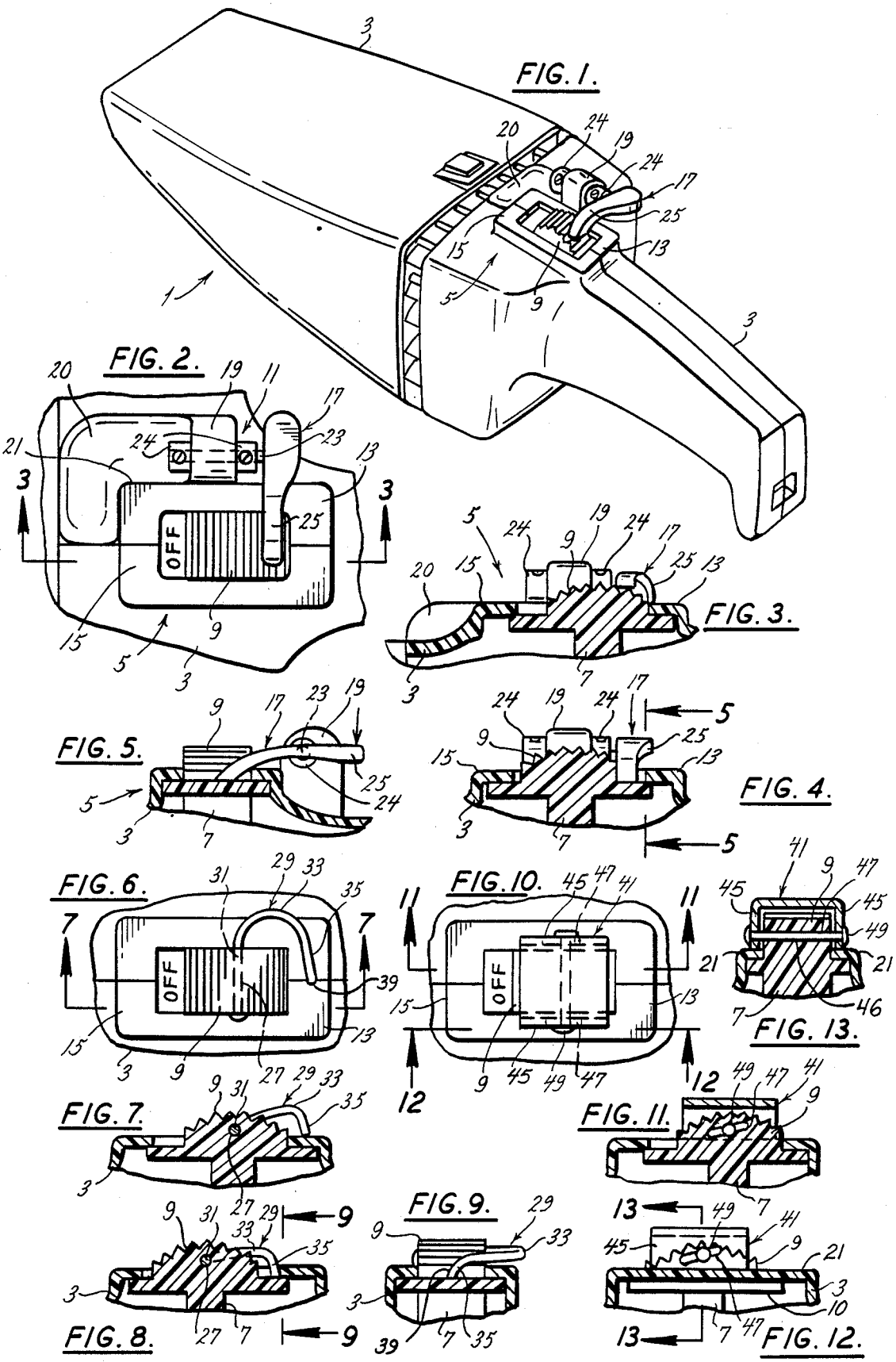
FIG. 1 is a perspective view of an electrically powered appliance (hand-held vacuum cleaner) employing a first embodiment of the locking mechanism of the present invention.
FIG. 2 is a top plan view of the embodiment shown in FIG. 1.
FIG. 3 is a sectional view of the embodiment, taken along line 3—3 in FIG. 2 and showing the locking mechanism in its first position.
FIG. 4 is the same sectional view shown in FIG. 3 with the locking mechanism in its second position.
FIG. 5 is a sectional view of the embodiment taken along line 5—5 in FIG. 4.
FIG. 6 is a partial top plan view of the appliance illustrating a second embodiment of the locking mechanism of the present invention.
FIG. 7 is a sectional view of the second embodiment, taken along line 7—7 in FIG. 6, and showing the second embodiment in a first position.
FIG. 8 is the same sectional view shown in FIG. 7 showing the second embodiment in its second position.
FIG. 9 is a sectional view of the second embodiment taken along line 9—9 in FIG. 8.
FIG. 10 is a partial top plan view of the appliance illustrating a third embodiment of the locking mechanism of the present invention.
FIG. 11 is a sectional view of the third embodiment taken along line 11—11 in FIG. 10.
FIG. 12 is another sectional view of the third embodiment taken along line 12—12 in FIG. 10.
FIG. 13 is a sectional view of the third embodiment taken along line 13—13 in FIG. 12.

Referring to the drawings, an electrically powered appliance, for example, a hand held vacuum cleaner is indicated generally 1. The appliance has a molded plastic cover 3 in which is formed a well 5. Situated in well 5 is a multiple position or "ON-OFF" switch 7 which controls application of power to the appliance. Switch 7 is spring loaded or otherwise biased to its "OFF" position. Thus, the user of the appliance can maintain the switch in its "ON" or non-biased position only by the constant application of manual force, e.g., thumb or finger pressure on a switch button 9. So long as the user pushes the button to the "ON" position of the switch the vacuum cleaner will run. If he relaxes this pressure, either because he wants the appliance to turn off or through fatigue, the biasing force on button 9 forces the switch back to its "OFF" position and power flow ceases.

It may be, however, that the user does not want to constantly have to apply pressure on the switch button to keep the appliance running. He may, for example, want to shift the vacuum cleaner from one hand to the other to reach an area to be cleaned more readily and does not want the cleaner shutting off while doing so. Or, he may have to clean a large area and does not want to suffer the fatigue resulting from constantly applying thumb pressure on the switch button.

The improvement of the present invention comprises a means or mechanism 11 for locking switch 7 in its non-biased position and maintaining the switch in that position without constantly applying manual force. As shown in the drawings, button 9 is movable from one end wall 13 of well 5 (the "OFF" position of switch 7) to the opposite end wall 15 thereof (the "ON" position of switch 7). Locking mechanism 11 includes a means 17 slidably coacting with switch 7 and moving from a first position to a second position as the switch is moved from its biased to its non-biased position to lock the switch in its non-biased position when means 17 reaches its second position.

As shown in FIGS. 1–5 a lug 19 is provided having a substantially ell-shaped base portion 20. The base portion 20 is adhesively or otherwise attached to cover 3 of appliance 1 adjacent a side wall 21 of well 5 snd is substantially larger than the lug 19 to facilitate adhesive attachment to said cover. A pivot shaft 23 extends through the lug parallel to the line of movement of button 9. A lever 25 has one end connected to shaft 23 (although the lever and the shaft may be integrally formed) and the other end of the lever rests on the back of button 9. As the button is pushed from its biased ("OFF") position to its non-biased ("ON") position, the one end of lever 25 slides down the back of the button from a first position shown in FIG. 3 to a second position shown in FIG. 4. In its second position, the bottom end of lever 25, which constitutes a blocking element, rests on the floor of well 5 and blocks or prevents movement of button 9 back to the biased position of the switch. Consequently, the switch is maintained in non-biased or "ON" position without the user having to keep his thumb or finger on the button. The end of lever 25 connected to shaft 23 is flattened or spatulate in shape so the user can raise the lever out of the well merely by pressing down on the flattened end of the lever and flipping the blocking end of the lever out of the well. Preferably, the lever 25 is weight-biased at the blocking end so that it falls into the well 5 under the weight of said blocking end and remains there until moved. Also the lever shaft 23 is provided with adjustable collars 24 which permit the lever to be readily adjusted thereby avoiding the need for unnecessary accuracy in the manufacture of the switch base portion 20.

In a second embodiment of the invention (see FIGS. 6–9), button 9 has a transversely extending opening 27 and the locking mechanism includes a generally U-shaped member 29 pivotally mounted to button 9 by having one leg 31 received in the opening 27. The base portion 33 of member 29 is sufficiently long as to extend beyond end wall 13 of well 5 when switch 7 is in its biased position. The other leg 35 of member 29 includes a downwardly inclined outer end lower portion 39 which slides along the top of the end wall 13 of the cover 3 as button 9 is pushed to the non-biased or "ON" position of switch 7 and falls into the well, behind button 9, as the button reaches the "ON" position. As with the first embodiment, lower portion 39 of leg 35, constitutes a blocking element but in this case engages end wall 13 and prevents button 9 from being pushed back to the biased position of switch 7. When the user desires to turn the appliance off, he releases button 9 by flicking member 29 upward with a thumb or finger.

A third embodiment of the invention (see FIGS. 10–13) includes a cap 41, which may be U-shaped, fitting over button 9. The side walls 45 of the cap rest on well sidewalls 21 of the cover 3 of the appliance. Button 9 has a transverse opening 46 formed therein and receiving a pin 49. Each of the cap side walls 45 includes a slot 47 and the slots incline downwardly from the rear to the front of the sidewalls. The pin 49 extends through the button and the ends of the pin are respectively received within the slots of side walls 45. When button 9 is pushed to move switch 7 from its biased to its non-biased position it carries cap 41 with it. When the button is at its farthest position it engages the end of the well and cap 41 moves forwardly relative to the button. This movement of cap 41 only by the operator, moves the pin 49 relatively in the slots 47 tending to move the flange 10 of button 9 upwardly against the underside of the upper portion of walls 21 and wedge the entire button 9 and cap 41 together whereby to friction lock button 9 in the non-biased switch position. When the appliance is to be turned off, reverse pressure on cap 41 frees the pin and allows the button to move to the biased position of the switch.

It will be noted that an appliance 1 could be retrofitted with a locking mechanism 11 so to enable a person already having an appliance with a spring loaded on-off switch to take advantage of the invention.

In view of the above, the several objects of the invention are attained.

I claim as my invention:

1. In an electrically powered appliance having a multiple position switch controlling application of power to the appliance, the switch being biased to one position whereby a user of the appliance can maintain the switch in another non-biased positon only by a constant application of manual force, an improvement comprising means for locking the switch in its non-biased position and maintaining the switch in that position without the constant application of manual force, the locking means including means slidably coacting with the switch and moving from a first position to a second position as the switch is moved from its biased to its non-biased position, the coacting means locking the switch in its non-biased position when the coacting means reaches its second position, the switch comprising a finger operated button movable from one position to another to move the switch from its biased to its non-biased position, and the locking means including a cap fitting over the button and resting on the cover of the appliance.

2. The improvement of claim 1 wherein the cap has transversely formed inclined slots and the coacting means includes a pin extending through the slots and connecting with the button to mount the cap on the button, the pin being slidably movable in the inclined slots relative movement of the cap, after the switch is moved to its non-biased position, wedging the button and the cap together to lock the button in the non-biased switch position.

3. An improvement in an electrically powered appliance having a multiple position switch controlling application of power to the appliance, the switch being biased to one position whereby a user of the appliance can maintain the switch in another non-biased position only by a constant application of manual force, the switch being a finger operated button mounted in a well having opposed end walls and opposed sidewalls, said button being movable from one end wall of the well to the opposite end wall thereof as the switch is moved from its biased to its non-biased position, and the improvement comprising means for locking the switch in its non-biased position and maintaining the switch in that position without the constant application of manual force, the locking means including means slidably coacting with the switch and moving from a first position to a second position as the switch is moved from its biased to its non-biased position, the coacting means including a blocking element which rests between the button and said one end wall of the well when the coacting means reaches its second position thereby locking the switch in its non-biased position, the coacting means also including a rotatable shaft mounted adjacent a side wall of the well and a lever having a first end connected to the shaft and a second end resting on the button when the button is in its biased position, said second end of said lever constituting the blocking element.

4. The improvement of claim 3 wherein the rotatable shaft is lengthwise adjustable to adjust the position of the lever.

5. The improvement of claim 3 wherein the second end of the lever is weight biased so that it tends to rest on the button.

6. An improvement in an electrically powered appliance having a multiple position switch controlling application of power to the appliance, the switch being biased to one position whereby a user of the appliance can maintain the switch in another non-biased position only by a constant application of manual force, the appliance including a cover inwhich a well is formed, the switch being a finger operated button mounted in the well having opposed end walls and opposed sidewalls, said button being movable from one end wall of the well to the opposite end wall thereof as the switch is moved from its biased to its non-biased position, the improvement comprising means for locking the switch in its non-biased position without the constant application of manual force, the locking mans including means slidably coacting with the switch and moving from a first position to a second position as the switch is moved from its biased position to its non-biased position, the coating means including a blocking element which rests between the button and the said one end wall of the well when the coacting means reaches its second position thereby locking the switch in its non-biased position, said coacting means also including a bae disposed adjacent the well and attached to the cover, the base having an upwardly extending lug attached thereto, the base being substantially larger than the lug and the coacting means also including a rotatable shaft mounted to the lug and a lever having a first end connected to the shaft and a second, weight biased end tending to rest on the button, the lever sliding down the back of the button as the switch is moved from its biased to its non-biased position whereby the second end of the lever, which constitutes the blocking element, locks the switch in its non-biased position.

* * * * *

UNITED STATES PATENT AND TRADEMARK OFFICE

CERTIFICATE OF CORRECTION

PATENT NO. : 4,920,244

DATED : April 24, 1990

INVENTOR(S) : Gundlach

It is certified that error appears in the above identified patent and that said Letters Patent is hereby corrected as shown below:

Column 1, line 9, delete "mementary" and insert --momentary--

Column 1, line 41, delete "worklace" and insert --workplace--

Column 3, line 7, delete "snd" and insert --and--

Column 4, line 2, add --,-- after "41 only"

Column 5, line 18, delete "inwhich" and insert --in which--

Colum 6, line 3, delete "mans" and insert --means--

Column 6, line 11, delete "bae" and insert --base--

Signed and Sealed this

Fifth Day of November, 1991

*Attest:*

HARRY F. MANBECK, JR.

*Attesting Officer*

*Commissioner of Patents and Trademarks*